US008300983B2

(12) United States Patent
Pinault

(10) Patent No.: US 8,300,983 B2
(45) Date of Patent: Oct. 30, 2012

(54) METHOD OF DETERMINING THE POSITION OF A DRILL HOLE TO BE DRILLED ON AN OPHTHALMIC LENS

(75) Inventor: Philippe Pinault, Meudon (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 805 days.

(21) Appl. No.: 12/519,650

(22) PCT Filed: Dec. 19, 2007

(86) PCT No.: PCT/FR2007/002111

§ 371 (c)(1),
(2), (4) Date: Jun. 17, 2009

(87) PCT Pub. No.: WO2008/093016

PCT Pub. Date: Aug. 7, 2008

(65) Prior Publication Data

US 2010/0074556 A1 Mar. 25, 2010

(30) Foreign Application Priority Data

Dec. 20, 2006 (FR) ..... 06 11124
Mar. 2, 2007 (FR) ..... 07 01554

(51) Int. Cl.

| | |
|---|---|
| ***G06K 9/36*** | (2006.01) |
| ***G06K 9/18*** | (2006.01) |
| ***G06K 9/00*** | (2006.01) |
| ***G02C 5/00*** | (2006.01) |
| ***G02C 1/02*** | (2006.01) |

(52) U.S. Cl. ..... 382/291; 382/186; 382/141; 382/152; 351/41; 351/110

(58) Field of Classification Search ..... None
See application file for complete search history.

(56) References Cited

U.S. PATENT DOCUMENTS 6,655,800 B2 * 12/2003 Takeda et al. ..... 351/110
(Continued)

FOREIGN PATENT DOCUMENTS

EP 1 053 075 9/2002
(Continued)

OTHER PUBLICATIONS

International Search Report dated Jul. 10, 2008, from corresponding PCT application.

*Primary Examiner* — Michelle Entezari
(74) *Attorney, Agent, or Firm* — Young & Thompson

(57) ABSTRACT

Method of determining the position of a target drill hole to be drilled in a target corrective lens having an expected target outline after shaping, the position being determined from a reference lens having a reference outline and at least one reference drill hole, the method includes: acquiring an image and at least one characteristic of the curvature of the reference lens; determining, in the acquisition plane, the reference distance in projection between the projection of a reference anchor point of the associated reference lens and the reference lens and the projection of a reference drilling point of the reference drill hole calculating the three-dimensional reference distance between the reference anchor point and the reference drilling point as a function of the characteristic of the curvature of the reference lens (100) and of the determined reference distance; and determining the position of the target drilling point for the target drill hole of the target corrective lens as a function of the calculated three-dimensional reference distance (R2; R5).

20 Claims, 6 Drawing Sheets

U.S. PATENT DOCUMENTS

| | | | | |
|---|---|---|---|---|
| 6,785,585 | B1 | 8/2004 | Gottschald | |
| 7,611,243 | B2 * | 11/2009 | Takeichi | 351/178 |
| 2005/0103759 | A1 * | 5/2005 | Li et al. | 219/121.67 |
| 2006/0178086 | A1 * | 8/2006 | Shibata | 451/6 |

FOREIGN PATENT DOCUMENTS

| | | |
|---|---|---|
| EP | 1 676 683 | 7/2006 |
| EP | 1 679 153 | 7/2006 |
| FR | 2 865 046 | 7/2005 |

* cited by examiner

Fig.4
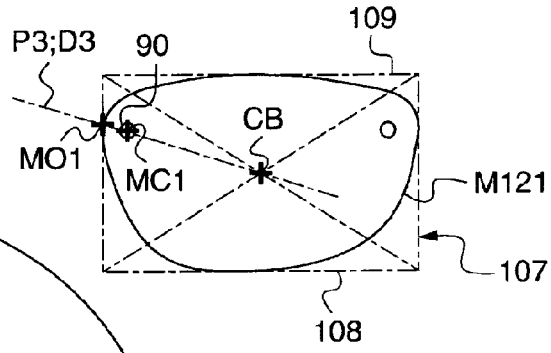
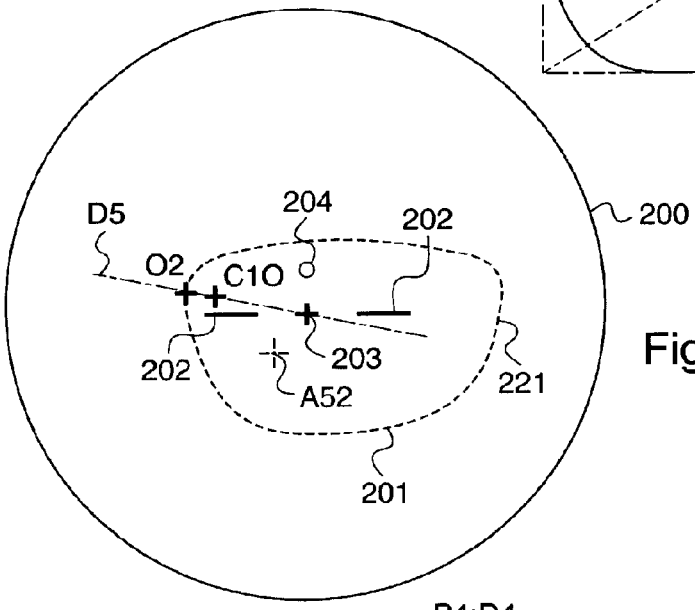
Fig.5
Fig.6
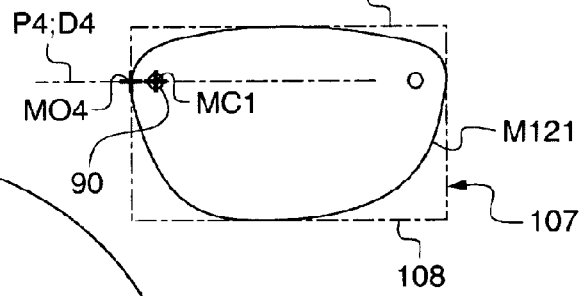
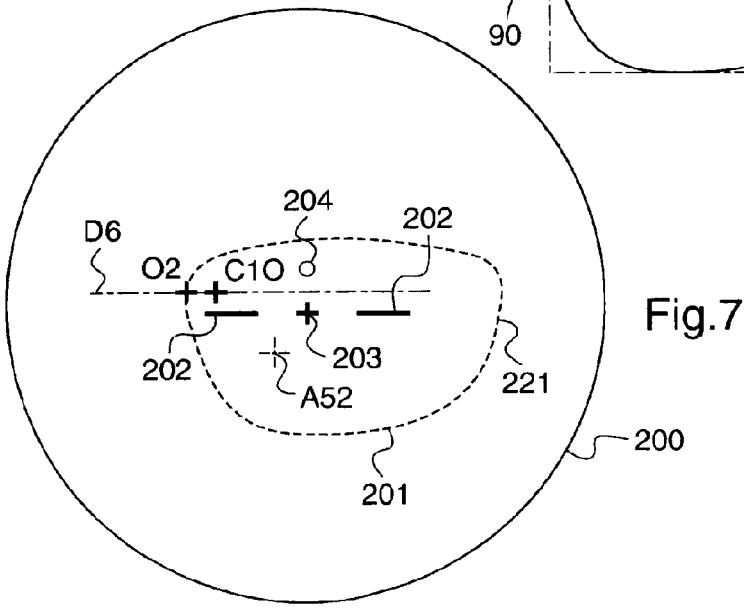
Fig.7

METHOD OF DETERMINING THE POSITION OF A DRILL HOLE TO BE DRILLED ON AN OPHTHALMIC LENS

TECHNICAL FIELD OF THE INVENTION

In a general manner, the present invention relates to eyeglasses and more precisely to drilling ophthalmic lenses with a view to mounting them on eyeglass frames of the rimless type.

The invention relates more particularly to a method of determining the position of a target drill hole to be drilled in a target corrective lens, on the basis of a reference lens that presents a reference drill hole.

TECHNOLOGICAL BACKGROUND

When an eyeglass frame is of the rimless type, after each of the corrective lenses for joining to the frame has been shaped, it is drilled appropriately so as to enable the temples and the nose bridge of the rimless frame to be fastened. The drilling may be performed with a grinder or with a separate drilling machine by means of a drill bit.

Usually, the following method is implemented. First, the future eyeglass wearer chooses a frame that is to his/her taste, which frame is equipped with reference lenses, commonly known as presentation lenses. Each reference lens is predrilled in its temporal and nasal portions and may thus be used as a model for appropriately shaping and drilling the target corrective lens for joining to the frame chosen by the future wearer.

The positioning of the target drill holes to be drilled in a target corrective lens can be inferred from the positioning of the reference drill holes in the reference lens. This positioning may be carried out manually: the optician measures the position of the reference drill holes and transfers these measurements onto the target corrective lens once it has been shaped.

But, in practice, it is advantageous to perform this positioning automatically. Patent EP 1 053 075 proposes a method of determining the position of a target hole to be drilled in a target corrective lens having an expected target outline after shaping, on the basis of a reference lens that presents a reference outline and at least one reference drill hole, identical to that of the reference lens. That method includes the following steps:

- acquiring an image of the reference lens, in particular with an image of its reference outline and an image of its reference drill hole, in an acquisition plane; and
- deducing therefrom the position relative to the target outline of the target drilling point for the target drill hole of the target corrective lens.

The reference lens is placed inside an image acquisition device for the lens, which device displays the image on a screen. The operator then proceeds to identify the reference drill holes by pointing to each hole on the screen. The processing system stores the positions of the reference drill holes relative to the image of the reference outline of the reference lens in the acquisition plane.

The target corrective lens is then centered. Its image is acquired in a centering plane in such a manner as to identify its optical frame of reference and to position accordingly the target outline desired for the target corrective lens. Then, after the target corrective lens has been shaped to the target outline that is identical to that of the reference lens, a drill bit of appropriate diameter is brought into register with a target drilling point of the target corrective lens.

This target drilling point is directly defined as the homologous projection of the reference drilling point in the acquisition and centering planes, in the sense that it is the point for which the projection in the centering plane (of the corrective lens) presents a position that is analogous with the position, in the acquisition plane (of the reference lens), of the reference drilling point of the reference lens.

The corrective lens is thus drilled by means of the drill bit being free to move relative to the lens along the axis of rotation of the drill bit. If the diameter of the drill bit is smaller than the desired diameter, the resulting hole is widened by appropriately moving the drill bit transversally.

However, it can be noted, in particular for lenses that are highly curved, that an error, often a large error, exists between the position of the target drill hole made in the target corrective lens and the position of the reference drill hole of the reference lens. This positioning error leads to difficulties mounting the target corrective lens together with the temples and the nose bridge of the frame and, in some circumstances, it may even lead to mounting being impossible or of poor quality. In this event, the optician is forced to rework the drill holes, which is time consuming, which requires expert knowledge, and which generates results that are often unsightly. Further, the corrective lens may be poorly positioned in front of the eye of the wearer, thereby reducing the effectiveness of the optical correction and possibly causing great discomfort to the wearer.

OBJECT OF THE INVENTION

The aim of the present invention is to determine accurately the position of the drill holes to be drilled in the target corrective lens for its assembly with the temples and the nose bridge of the rimless eyeglass frame chosen by the wearer.

More particularly, the invention proposes a method of determining the position of the target drill hole to be drilled in the target corrective lens having an expected target outline after being shaped, on the basis of a reference lens that presents a reference outline and at least one reference drill hole, the method comprising the following steps:

- acquiring an image of the reference lens in an acquisition plane, in particular including an image of its reference outline and an image of its reference drill hole;
- acquiring at least one characteristic of the curvature of the reference lens;
- determining, in the acquisition plane, the reference distance in projection between the projection of a reference anchor point of the reference lens, this reference anchor point being associated with the reference outline, and the projection of a reference drilling point of the reference drill hole;
- calculating the three-dimensional reference distance between the reference anchor point of the reference lens and the reference drilling point of the reference drill hole as a function of said characteristic of the curvature of the reference lens and of the determined reference distance in projection;
- determining the position of a target drilling point for the target drill hole of the target corrective lens relative to the target outline, as a function of the calculated three-dimensional reference distance.

When the target corrective lens is drilled, e.g. from the front face of the lens, the drill bit drills the lens at a target drilling point that has already been identified. In the state of the art, the target drilling point is identified so that, if the images of the reference and corrective lenses are superposed in projection in the acquisition and centering planes in such a manner as to make their respective reference outlines and targets coincide, then the image of the drilling point of the corrective lens coincides with the image of the reference drilling point of the reference lens.

However, the applicant has noticed that the real distances (in three-dimensions and not in projection) between the edge faces of the lenses and their drill holes differ from one lens to another. The applicant has determined that this error mainly stems from the differences in curvature of the reference and corrective lenses.

Therefore an error is produced when the acquired distance on the reference lens is transferred onto the target corrective lens. Because of this error, the target drill hole made in the target corrective lens is in practice offset relative to the ideal position in which it should be found. Consequently, the drill holes of the target corrective lens risk being too far away from the edge face of this lens, so that the temples or the bridge of the frame cannot engage in the drill holes. Also, this error may further give rise to an error in centering target corrective lenses in front of the eyes of the wearer, because the correct positioning of the drill holes determines the positioning of the optical reference of the lens in front of the eyes of the wearer.

By the method of the invention, the real three-dimensional distance between the edge face (or any other identified point) of the reference lens and the reference point of the reference drill hole may be determined using the curvature of the reference lens. With this distance being known, it is possible to transfer said distance onto the corresponding optical face of the target corrective lens, in such a way that the real three-dimensional distance between the edge faces of the corrective lens and of its target drill hole is identical to the distance determined on the reference lens. As a result, this distance no longer depends on the projection plane in which the image of the reference lens is acquired. The bridge and the temples of the frame may thus be assembled with the corrective lenses in the desired position and without any difficulty, thereby making it possible to correctly position the lenses in front of the pupils of the eyes of the wearer so that the lenses best perform the optical functions for which they were designed.

The reference and target drilling points for the drill holes of the reference lens and of the target corrective lens "correspond", in the sense that they are of the same kind relative to the drill hole concerned. By way of example, if the reference point of the reference drill hole is selected to be the center of the orifice in the front face of the reference drill hole, the reference point of the target drill hole also coincides with the center of its orifice on the front face.

In contrast it can be understood that the reference points of drill holes in the reference and corrective lenses are not "homologous" because of the difference in the curvatures of the lenses. If the images of the reference and corrective lenses are acquired and are superposed, the images of the two reference points do not coincide, because of the corrective action provided for by the invention.

More generally, it is considered below that two points are "homologous" if they belong to corresponding optical faces of the target corrective lens and of the reference lens, and if, in addition, the images of these two points are superposed when the images of the reference lens and of the corrective lens are superposed in a single plane, so that all or part of their outlines correspond.

In addition, it should be observed that the anchor points and the drilling points are projected into the acquisition plane along a single projection direction that is perpendicular to a general plane of the lens or parallel to the illumination axis or the image capture axis.

According to a first advantageous characteristic of the invention, in order to determine the position of the target drilling point for the target drill hole, a target anchor point of the target corrective lens homologous to the reference anchor point of the reference lens is identified and the position of the target drilling point is calculated as a function of the target anchor point and of the three-dimensional reference distance.

The reference anchor point and the reference drilling point belong to a single reference face of the reference lens, and the target anchor point and the target drilling point belong to a single target face of the target corrective lens, said reference face and said target face corresponding to each other.

In order to calculate the position of the target drilling point, the three-dimensional reference distance is transferred onto the target corrective lens, starting from said target anchor point, substantially along a transfer direction linking the target anchor point to the target drilling point.

The target anchor point of the target corrective lens is homologous to the reference anchor point of the reference lens in the meaning defined above. Thus, if the reference anchor point of the reference lens is positioned on the outline of the lens, the target anchor point of the target corrective lens is positioned on the same outline point after the corrective lens has been shaped (the outlines are identical). In the same way, if the reference anchor point of the reference lens is positioned in the center of another of the reference drill holes associated with an already-determined target reference point, the target anchor point of the target corrective lens is constituted by the center of the target drill hole. The anchor points of the target corrective lens and of the reference lens are therefore not necessarily homologous.

Various types of drill and different types of method exist for use, according to the invention, in positioning a drill bit in register with the drilling point of the corrective lens. One of these methods consists in following tangentially the edge face of the already-shaped corrective lens with the drill bit, and then in moving the drill bit in a direction that is parallel to the plane tangential to the zone for drilling in the front face of the corrective lens. This movement, if made through a distance corresponding to the previously-calculated distance, thus allows the drill bit to be correctly positioned in register with the desired drilling point so that the frame can be accurately assembled with lens.

In another embodiment of the invention, in order to calculate the position of the target drilling point for the target drill hole, at least one characteristic of the curvature of the target corrective lens is determined, and the target distance in projection is calculated, in a centering plane that is analogous with the acquisition plane, between the projection of the target drilling point of the target drill hole of the target corrective lens and the projection of the target anchor point of the target corrective lens, as a function of the three-dimensional reference distance and of the characteristics of the curvature of the target corrective lens.

The anchor points of the reference and corrective lenses are homologous in the meaning explained above.

The image of the reference lens is acquired in a given acquisition plane. In addition, the image of the corrective lens is acquired, for centering purposes, in a given centering plane. These planes are analogous in that they are inclined in substantially the same manner relative to the lenses, so that the outline of the image of the reference lens is identical to the outline of the image of the corrective lens. Typically, these acquisition and centering planes are substantially parallel to mean planes of the reference lens and of the target corrective lens, or to mean planes of the outlines of the lenses. It is thus possible to consider the images of the reference and corrective lenses in a single virtual plane in which the acquisition and centering planes are caused to coincide.

At this stage, the three-dimensional reference distance that ought to separate a target anchor point of the corrective lens from a reference point for the target drill hole is known. However, generally, grinders and drills identify the position of the drill bit in a plane corresponding to the above-mentioned centering plane. It is therefore appropriate to determine the distance between the projections of these two points onto the centering plane, so as then to be able to position the drill bit simply and accurately relative to the corrective lens.

Preferably, in order to determine said characteristic of the curvature of the target corrective lens, an approximate point near to the target drilling point of the target drill hole is identified on one of the optical faces of the target corrective lens, said optical face of the target corrective lens is sensed by feeling at least three points situated in the neighborhood of the approximate point (typically at less that 10 millimeters (mm)), and therefrom there is deduced an angle of inclination, relative to the centering plane of said optical face of the corrective lens at said approximate point, said angle thus constituting said looked-for characteristic of curvature.

The approximate point is a point of the corrective lens that is considered to be close, or that is calculated to be close, to the drilling point of the target drill hole. This approximate point may for example be the point homologous to the reference point of the reference drill hole of the reference lens.

The relative positions of the three sensed points allow the shape of the sensed optical face of the lens to be estimated, in the vicinity of the approximate point. Since the shape of the optical face of the lens does not present large variations in this vicinity, this shape is assumed to be identical to the shape of the lens in the neighborhood of the point where said lens is to be drilled. The sensing thus makes it possible in particular to deduce the inclination of the axis along which the corrective lens should be drilled to ensure that the target drill hole opens out orthogonally into the sensed optical face.

This inclination further provides a value for the curvature of the corrective lens that allows the position of the projection of the reference point of the target drill hole to be determined in the centering plane.

In a variant, in order to determine said characteristic of the curvature of the corrective lens, the overall curvature of one of the optical faces of the target corrective lens is acquired, an approximate point near to the target drilling point of the target drill hole is identified on one of the optical faces of the target corrective lens, and an angle of inclination relative to the centering plane is calculated for the target corrective lens at the approximate point as a function of said overall curvature and of the position of the approximate point, said angle thus constituting said looked-for characteristic of the curvature.

The optical front face of a lens is generally approximately circumscribed on a sphere with a radius of curvature that is generally supplied to the optician by the manufacturer of the lens. Thus, the radius of curvature of this sphere and the position of the approximate point of the drilling point make it possible to estimate the inclination of the axis along which the lens is to be drilled. In this implementation also, the angle further makes it possible to determine the position of the projection in the centering plane of the reference point of the target drill hole.

Other advantageous and non-limiting characteristics of the method of the invention are as follows:

the reference anchor point of the reference lens is identified as the point having its projection in the acquisition plane situated at the intersection between, firstly, a projected outline resulting from the projection of one of the front and rear edges of the edge face of the reference lens or of an average of these edges, and, secondly, a reference anchor line passing through the projection of the reference drilling point of the reference drill hole; this reference anchor line can in particular be the line that passes through the projection of a geometrical center of the reference lens, such as the boxing center, or that is parallel to the horizon line of the reference lens;

the target anchor point of the target corrective lens is identified as the point, for which the projection in a centering plane is analogous to the acquisition plane presents a position corresponding to that of the projection of the reference anchor point of the reference lens in the acquisition plane;

in order to determine the position of the target drilling point it is considered that the projection of the point in a centering plane that is analogous to the acquisition plane belongs to a target anchor line corresponding to the reference anchor line;

for a reference lens that includes two adjacent reference drill holes designed to hold a common temple or a common nose bridge of a frame, namely a first reference drill hole and a second reference drill hole, and for a corrective lens that presents two target drill holes to be drilled, comprising a first target drill hole that corresponds to the first reference drill hole of the reference lens and the position that is already identified, and a second target drill hole, in order to determine the second target drill hole, the reference anchor point of the reference lens is constituted by the reference drilling point of the first reference drill hole; and the target anchor point of the target corrective lens is constituted by the target drilling point of the first target drill hole.

DETAILED DESCRIPTION OF AN EMBODIMENT

The following description with reference to the appended drawings, given by way of non-limiting example, makes it well understood what the invention consists in and how it can be reduced to practice.

In the appended drawings:

FIGS. 4 and 6 are two similar views of the image of the FIG. 1 reference lens as projected onto the acquisition plane, showing two defined reference anchor lines;

FIGS. 5 and 7 are two front views of the target corrective lens of FIG. 4 before machining;

The aim of the method of the invention is to determine the position for a target drill hole that is to be drilled on a corrective lens as a function of the position of a reference drill hole in a reference lens, which position itself needs to be acquired.

The method thus includes a first step of acquiring the position of the reference drill holes in the reference lens.

Image Acquisition Device

Figure 1:
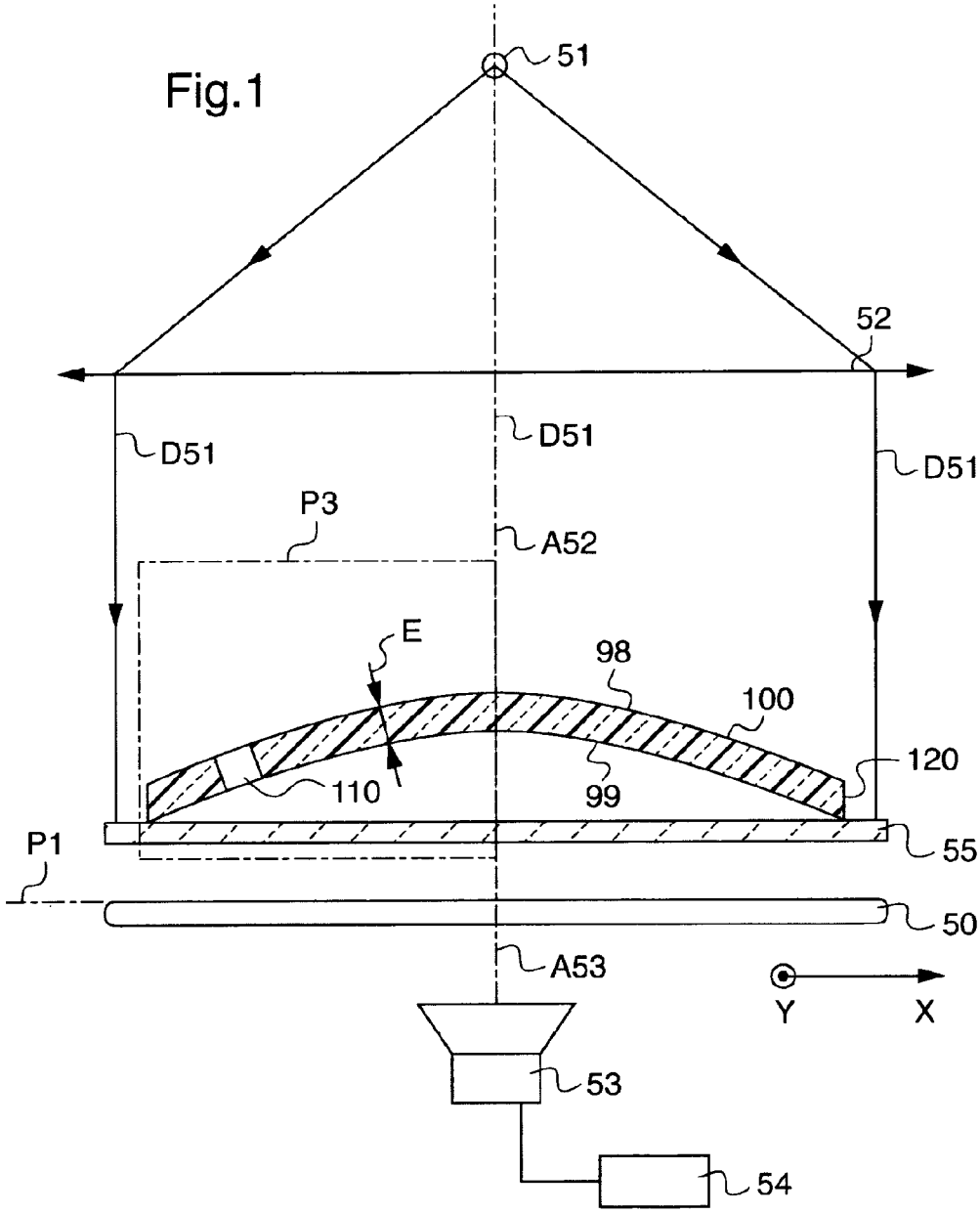
FIG. 1 is a diagrammatic view in axial section of an device for acquiring the position of drill holes on a reference lens.

FIG. 1 shows an example of a device for acquiring the position of reference drill holes in a lens in a pair of reference eyeglasses, enabling the method of the invention to be implemented. This acquisition device comprises lighting means 51, 52, a support 55 for holding a reference lens 100 (typically consisting of a display lens that is used to display the frame) and capture means 53 for capturing an overall image of the lens.

The lighting means 51, 52 include a collimator lens 52 on an axis A52 and a light source 51 placed at the focal point of the collimator lens 52. After passing through the collimator lens 52, the rays of light are thus directed parallel to the axis A52 of the collimator lens 52. The lighting direction D51 is thus parallel to the direction of the axis A52.

The capture means 53 comprises a camera 53 provided with a lens having an optical axis A53. The device for acquiring the position of the reference drill holes comprises an optical axis defined as being the axis A52 of the collimator lens 52 and the axis A53 of the acquisition means lens 53. The direction of image capturing by the acquisition means 53 here coincides with the lighting direction D51. The lighting and image capture directions naturally match, possibly after reflection.

The support 55 of the reference lens 100 is designed in such a manner that the reference lens 100 extends in a plane that is generally transverse to the lighting direction D51. The lens 100 is thus lit from the front.

The reference lens 100 presents an edge face 120 that possesses a front edge 121 and a rear edge 122. The edge face 120 in this example is cylindrical on an axis parallel to the lighting and image capture direction and therefore in this embodiment perpendicular to the acquisition plane. The edge face 120 could however be in a different shape, in particular conical or similar, so that its projection onto the acquisition plane would no longer be linear and that the projections of its edges 121, 122 would no longer coincide but be distinct. In the embodiment shown, attention is given to the front face of the reference lens 100 and therefore to the front edge 121. Naturally, analogously, the rear face or a mean virtual surface could be represented.

The general plane of the lens typically consists of a mean or mediator plane of one and/or the other of the surfaces of the lens, or even in a mean or mediator plane of one and/or the other of the edges 121, 122 of its edge face 120.

The support 55 of the lens 100 is presented in this embodiment in the form of a transparent disk made out of glass perpendicular to the lighting direction D51, so that neither the front face 98, nor the rear face 99 of the reference lens 100 is hidden from sight by the support 55.

In this embodiment, the reference lens 100 includes two reference drill holes, a first reference drill hole 110 situated beside the temporal area and another drill hole (not visible in FIG. 1) situated beside the nasal area of the lens. The rest of the description gives details only about the reference drill hole 110, but this description applies also to the acquiring of the other drill hole. In a variant, if this lens included a greater number of drill holes, the following description would also apply to the additional drill holes.

Figure 2:
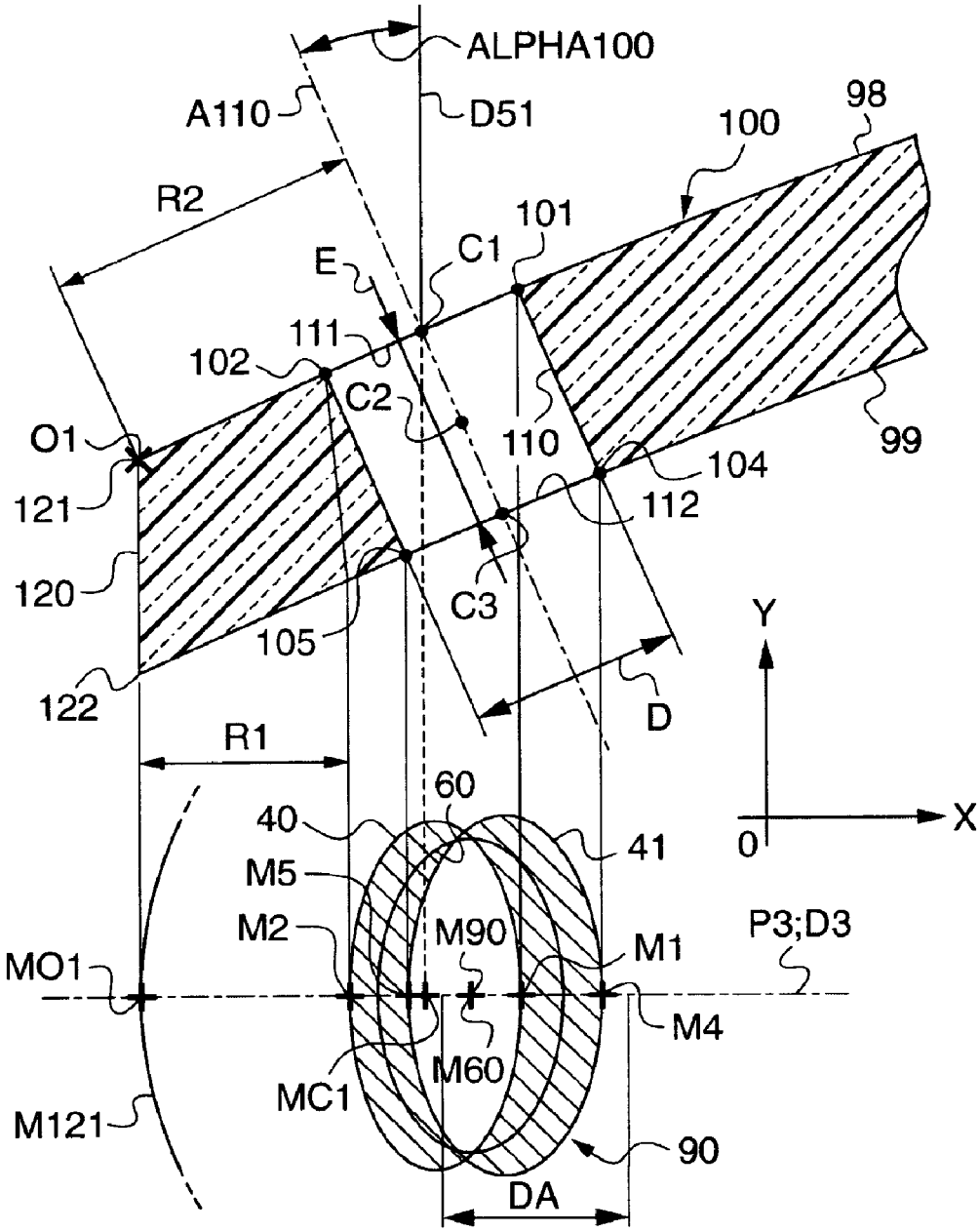
FIG. 2 is a combined view, with a top portion showing in axial section the drill hole of the reference lens of FIG. 1, and a bottom portion showing, in an acquisition plane, the overall projected shadow image of the drill hole, including points that are used for calculating the position of the drill hole.

As shown in the top portion of FIG. 2, the reference drill hole 110 includes, firstly, a front orifice 111 that opens out into the front face 98 of the lens 100 and, secondly, a rear orifice 112 that opens out into the rear face 99 of the lens 100. The center C2 of the reference drill hole 110 is itself also defined as the mean position of the centers C1, C3 of the front and rear orifices 111 and 112. In this embodiment, the point C1 of the front orifice 111 of the reference drill hole 110 is considered as a reference drilling point.

The image capture means 53 (FIG. 1) communicate in addition with a computer and electronic processor system 54. As explained below, the processor system 54 is designed to determine from the acquired image the position of the center C1 of the orifice 111 of the reference drill hole 110 in the front face 98. Naturally, in a variant, the processor system 54 may also be designed to determine from the acquired image the position of the center of the orifice 112 of the reference drill hole 110 in the rear face 99, or any other point associated with the drill hole and defined as the reference drilling point.

In a first embodiment shown in FIGS. 1 and 2, the device for acquiring the position of the drill holes is designed in such a manner that the camera 53 sees the lens in a projected view. In this embodiment, the lighting means 51, 52 and the camera 53 are distributed on both sides of the lens support.

As shown in FIG. 1, a plate 50 made out of frosted glass is disposed between the camera 53 and the support 55 of the lens. The frosted glass plate 50 is centered on the axis A52 of the collimator lens 52 and extends along the plane transverse to the axis A52. The frosted glass plate 50 makes it possible to determine the shadow of the reference lens 100 assembly to be formed and, in particular, the shadow of the reference drill hole 110 of the lens. The front face of the frosted glass plate 50 thus forms an acquisition plane P1 of the image of the reference lens 100. The acquisition plane is parallel to the general plane of the reference lens 100.

Preliminary Image Processing

In reference to FIG. 4 and by convention, the processor system 54 determines, from the image of the outline of the reference lens 100, a virtual rectangular box 107 having each of its four sides passing through a single point of the projected image of the outline of the reference lens 100. The outline under consideration of the reference lens 100 typically consists in one of the front 121 and rear 122 edges of the edge face 120 of the reference lens 100, or in an average for the two edges, corresponding to the definition used for the reference drilling point. In the example shown, the image M121 of the front edge 121 of the edge face 120 of the reference lens 100 is taken into consideration (which happens here to coincide with the image of the front edge of the lens, but which could be different as stated above).

Under wearing conditions two long sides 108, 109 of the box are horizontal and thus form horizon lines. The processor system calculates the intersection of the box 107 diagonals that constitutes the projected image of a geometrical center of the outline of the reference lens 100, known as the boxing center CB.

The processor system 54 also processes the shadow image (or projection) of the reference drill hole 110 of the reference lens 100. This image shown in the bottom portion of FIG. 2 creates an overall view 90 of the reference drill hole 110.

The overall view 90 of the reference drill hole 110 comprises two rings 40 and 41, of substantially oval shape, that intersect each other. The first ring 40 is the projected shadow of the orifice 111 in the front face of the reference drill hole 110, and the second ring 41 is the projected shadow of the orifice 112 in the rear face. The portion constituted by the overlap between the two rings 40, 41 is pale. This portion is the result of a portion of the reference drill hole through which the light rays pass being projected without touching the material of the lens. Conversely, the non-overlapping portions of the two rings are dark as a result of the rays being reflected or diffused by the side wall of the drill hole.

With reference to FIGS. 2 and 4, various points on the drill hole 110 of the reference lens 100 can be defined together with the corresponding projected points of the overall view 90 of projection of the reference drill hole 110. The point 102 of the reference drill hole 110 lies at the intersection between a section plane P3 and the portion of the outline of the orifice 111 in the front face 98 of the reference drill hole 110 in the reference lens 100, said portion being situated towards the outside of the lens. In addition, the point 101 is defined as being the point of intersection between the section plane P3 of the reference lens 100 and the portion of the outline of the orifice 111 in the front face 98 of the reference lens situated towards the inside of the lens. Points 105 and 104 are defined as being the points of intersection between the section plane P3 and the portion of the orifice 112 in the rear face 99 of the reference lens situated respectively towards the outside and the inside of the lens.

The section plane may be defined in various ways. In the embodiment shown in FIGS. 4 and 5, the section plane P3 is the plane of FIGS. 2 and 3. It is defined as:

being substantially perpendicular to the general plane of the reference lens 100 or, which is almost the same, parallel to the lighting or image capture direction D51; and containing the center C2 of the reference drill hole 110. The section plane P3 is the plane that contains the center C2 of the reference drill hole 110 and the boxing center CB of the reference lens 100.

Another example of a definition for the section plane is considered below.

The processor system 54 operates using the image acquired in projection. To this end, as shown in the bottom portion of FIG. 2, a reference anchor line D3 is defined as being straight, passing through the centers of the two rings 40, 41 and is identified as such by the processor system 54. This reference anchor line D3 corresponds to the dotted line in the acquisition plane P1 of the section plane P3 defined above.

Points M1 and M2 are thus identified by the processor system 54 as being the points of intersection of the reference anchor line D3 respectively with the right (inner) portions and with the left (outer) portions of the ring 40 as shown in FIG. 2. The points M1 and M2 are the image points of the points 101 and 102. In addition, points M4 and M5 are identified by the processor system 54 as being the points of intersection between the straight line D3 and the right (inner) and left (outer) portions of the second ring 41 respectively. The points M4 and M5 are the image points of the points 104 and 105. XM1, XM2, XM4, and XM5 mark the positions of points M1, M2, M4, and M5 on the straight line D3.

The processor system 54 identifies the point MO1 that is situated at the intersection of the reference anchor line D3 with the outline image M121 of the reference lens 100. The point MO1 is the projection of the reference anchor point O1 that is situated at the intersection of the section plane P3 and of the front edge 121 of the reference lens 100. The straight line D3 thus forms a linear marker with its origin at point MO1.

In a variant, as shown in FIG. 6, the reference anchor line D3 as defined above, can be replaced with a reference anchor line D4 that passes through the projection MC2 of the center C2 of the reference drill hole 110 and that is horizontal under wearing conditions, i.e. parallel to the horizon lines 108, 109 of the box 107.

The straight line D4 corresponds to the trace in the acquisition plane P1 of a section plane P4 defined as:

being substantially perpendicular to the general plane of the reference lens 100;

being parallel to the horizon line of the reference lens 100; and passing through the center C2 of the reference drill hole 110.

The processor system thus identifies the reference anchor point O4 of the reference lens 100 as the point having its projection MO4 situated at the intersection of a reference anchor line D4 and of the outline image M121 of the reference lens 100.

Determining the Reference Distance in Projection R1

Point MC1 is the image point of the center C1, in projection on the acquisition plane P1, of which the position XMC1 on the straight line D3 is to be calculated. The position XMC1 of the center C1 thus enables the distance R1 separating the point MC1 from the origin MO1 of the linear marker to be determined. This distance R1 is referred to as the reference distance in projection.

This first method provides for determining the position XM90 of the center M90 of the overall view 90 of the reference drill hole 110 and thus for determining the position of the image MC1 of the center C1 of the orifice 111 in the front face 98 of the drill hole.

The processor system 54 comprises a user interface and a display screen (not shown) that displays the overall view 90 of the reference drill hole 110. The processor system 54 is also designed so as to enable a identification marking ring 60 to be displayed on the screen. This ring presents dimensions that may be modified by the operator. The processor system 54 is also designed in such a manner that the identification marking ring 60 can be moved around the display screen by the operator. The identification marking ring 60 can be moved and its dimensions can be adjusted with the help of control tools integrated into the user interface of the processor system 54.

The operator sizes and centers the identification marking ring 60 onto the overall view 90 of the reference drill hole 110. For centering the identification marking ring 60 onto the overall view 90, the operator may, e.g. as shown in FIG. 2, superpose the identification marking ring 60 onto the overall view 90 in such a manner that the identification marking ring 60 passes through the middles of the segments M1M4 and M2M5. The optician may alternatively make provision for adjusting the position and the dimensions of the identification marking ring 60 so that it passes through the points M1 and M5 beside the light portion of the overall view 90. The optician may also adjust the position and the dimension of the identification marking ring 60 so as to make it pass through the points M2 and M4 beside the dark portion of the overall view 90.

Once the ring is centered onto the image of the shadow of the drill hole, the processor system 54 automatically detects and stores the position of the center M60 of the identification marking ring 60. The position of the center M60 is associated with the position XM90 of the center M90 of the overall view 90 by the processor system 54.

In a variant, provision can be made for the operator to use a tool built into the user interface such as a mouse or a stylus, to point to the center M60 of the identification marking ring 60, which center is then stored.

The processor system 54 calculates the position XMC1, on the straight line D3, of the image MC1 of the center C1 of the front orifice of the reference drill hole 110 from the position of the center M90 of said overall view 90 and as a function of the angle of inclination ALPHA100 of the reference drill hole 110 and of the thickness E of the lens. The angle of inclination ALPHA100 is the angle formed between the mean lighting direction D51 and the axis A110 of the reference drill hole. The angle ALPHA100 and the thickness E of the lens can be measured by feeling the lens, for example, or by the operator entering data manually with the help of an on-screen data entry interface provided for this purpose. The given thickness of the lens may be the local thickness of the lens about the reference drill hole or the mean thickness of the lens.

The position XMC1 of the center C1, and therefore of the distance R1, is calculated as follows:

$$XMC1=XM90-E/2\cdot\sin(\text{ALPHA}100)$$

The processor system 54 thus associates said calculated position with the looked-for position of the center C1 of the orifice of the reference drill hole 110 opening out in the front face 98 of the lens 100.

The processor system also calculates the value of the diameter D of the hole 110. This calculation depends on the method used for superposing the identification marking ring 60 on the overall view 90. When the identification marking ring 60 is superposed on the overall view 90 in such a manner that the identification marking ring 60 passes through the middle of the segments M1M4 and M2M5, the diameter D has a value of:

$$D=DA/\cos(\text{ALPHA}100)$$

DA being the diameter of the identification marking ring 60.

In a variant of this acquisition method, the center M60 of the identification marking ring 60 is detected automatically by the processor system 54, which is thus designed to superpose (with appropriate centering and sizing) the identification marking ring 60 automatically on the overall view 90 of the reference drill hole 110, and to thus determine the position and the diameter of the center M60 of the ring.

In other variants, it is also possible to acquire the distance R1 while taking account of the prismatic deflections caused by the reference lens 100 (the image of the point 102 is deflected by the reference lens 100), or indeed solely from the easily identifiable positions of the points M1 and M2. Such variants of the methods of acquiring the distance R1 are explained more precisely in French patent application FR 06/11124.

The angle ALPHA100 can also be calculated using the positions XM1 and XM4 of the points M1 and M4 with the following equation, in the measuring configuration defined above in projected view (FIG. 2):

$$\begin{aligned} ALPHA100 &= \arcsin(\text{abs}(XM1 - XM4/E) \\ &= \arcsin(\text{abs}(XM5 - XM3/E). \end{aligned}$$

The thickness E of the lens may be measured for example by feeling or it may be set at a mean value of about 2 mm.

In summary, at this stage in the implementation of the method of the invention, the distance R1 between the projection MO1 of the reference anchor point O1 of the reference lens 100 and the projection MC1 of the center C1 of the orifice in the front face of the reference drill hole 110 is known. The angle of inclination ALPHA100 of the drilling axis A110 of the reference drill hole 110 relative to the lighting axis D51 is also known.

Calculating the Three-Dimensional Reference Distance R2

Figure 3:
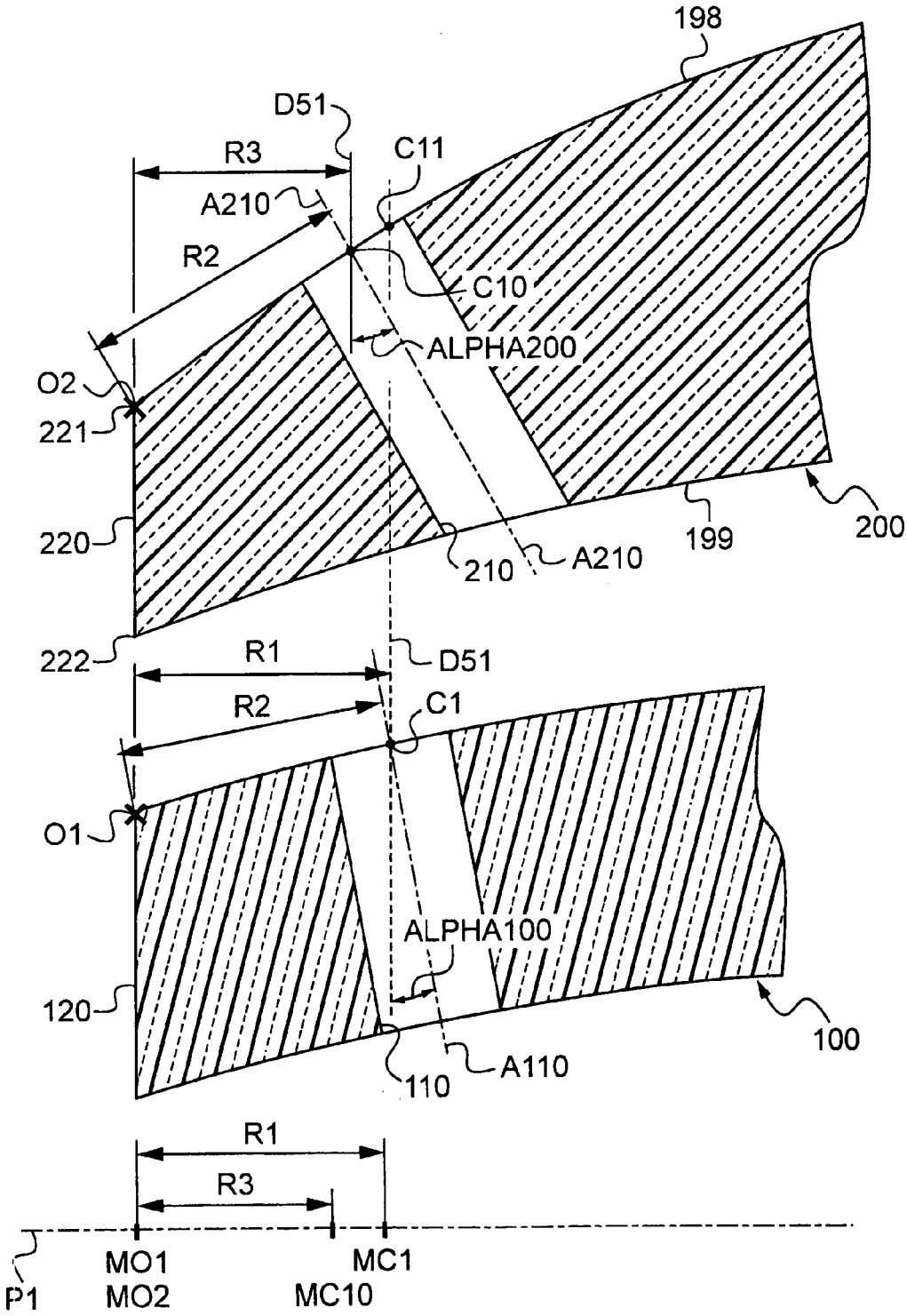
FIG. 3 is a combined view, with a bottom portion in section showing the drill hole of the FIG. 1 reference lens, and a top portion in section showing a portion of the drilled corrective lens using the method in accordance with the invention.

As shown on the bottom portion of FIG. 3, the processor system 54 then proceeds to calculate a three-dimensional reference distance R2, i.e. in space as opposed to in projection, between the reference anchor point O1 of the reference lens 100 and the center C1 of the orifice in the front face of the reference drill hole 110. As a result of the curvature of the reference lens 100, the distances R1 and R2 are different.

The reference anchor point O1, the center C1 of the orifice in the front face of the reference drill hole 110, and their respective projections on the acquisition plane P1 are coplanar (on the radial plane P3 corresponding to the section plane of the bottom portion of FIG. 3).

Since the axis A110 of the reference drill hole 110 is orthogonal to the tangent plane in the front face of the reference lens 100 at the point C1, the angle ALPHA100 as determined above enables the distance R2 to be estimated using the following calculation:

$$R2=R1/\cos(\text{ALPHA}100).$$

The three-dimensional reference distance R2 is thus the distance that, when transferred onto any target corrective lens presenting curvature that is identical to or different from the curvature of the reference lens 100, makes it possible to determine the position at which it is necessary to drill the corrective lens so that the bridge or the temples of the selected frame are able to be engaged without difficulty onto the corrective lens.

The three-dimensional reference distance R2 should nevertheless be transferred along the curvature of the front face of the corrective lens concerned. It is therefore appropriate to take account of the curvature of the corrective lens 200.

Determining the Position of the Target Drilling Point C10

As shown on the top portion of FIG. 3, the processor system 54 then proceeds to identify a target drilling point C10 in the front face 198 of the corrective lens 200 at which it is necessary to drill the corrective lens 200. Here, the target drilling point C10 corresponds to the center of the orifice in the front face of the target drill hole 210 to be drilled on the corrective lens 200.

Prior to identifying the position of the target drilling point C10, the optician proceeds to center the corrective lens 200. This centering consists in determining the position that the corrective lens 200 will occupy on the frame selected by the wearer, so as to be suitably centered facing the pupil of the eye of the wearer in order to suitably carry out the optical function for which it was designed. This operation consists therefore in correctly positioning the final outline along which the corrective lens 200 should be shaped. The shape of the final outline is known, since the final outline is identical to the outline acquired from the reference lens 100.

Concretely, in order to perform this centering, the optician initially puts a reference eyeglass frame that is identical to the frame selected by the wearer and that is provided with reference lenses into place on the wearer, and determines on each lens the position of the pupil point facing the pupil of the corresponding eye of the wearer. More precisely, the optician measures or acquires in conventional manner two parameters associated with the morphology of the wearer, namely the pupillary half distances defined as being the distances between each pupil of the wearer and the center of the nose, and the heights of the wearer's pupils relative to the outline. Knowing these parameters enables the optician to locate the position of the outline of the reference lens relative to the pupil point of the wearer.

Secondly, the optician places the corrective lens 200 into an illumination and image acquisition device, e.g. such as that described above and shown in FIG. 1. The optician thus acquires the image of the non-edged corrective lens 200 on a centering plane corresponding to the acquisition plane P1. As shown in FIG. 5, the corrective lens 200 is provided with erasable visible markers 202, 203 that appear on the acquired image. Here, the corrective lens 200 presents in particular a visible marker 203 that corresponds to the optical centering point of the corrective lens that is to be positioned facing the pupil of the wearer's eye. Knowing the position of the pupil point relative to the final outline 201, the optician virtually superposes the pupil point on the optical centering point 203 of the corrective lens 200 and thus positions the final outline 201 on the corrective lens 200. The optician performs this positioning by orienting the final outline 201 relative to the corrective lens 200 as a function of the optical prescriptions of the wearer (in particular as a function of the prescribed cylinder axis). The optician thus determines the position of the final outline 201 to which the corrective lens 200 should be shaped.

The processor system 54 may consequently store and display the image of the non-edged corrective lens 200 on the screen 50 with the image of the final outline 201 superposed thereon.

At this point, a point of the corrective lens 200 is said to be homologous to a point of the reference lens 100 if, firstly, the two points are positioned on corresponding front or rear optical faces of the two lenses, and if, secondly, the images of the two points coincide when the image of the outline of the reference lens 100 and the image of the final outline of the corrective lens 200 are superposed virtually.

As shown in FIG. 5, the processor system 54 defines a target anchor line D5, in projection onto the centering plane analogous to the acquisition plane, and thus here substantially parallel to the mean plane of the lens, which target anchor line D5 corresponds to the line D3 associated with the reference lens 100. In the example shown in FIGS. 4 and 5, this target anchor line D5 is defined as being the straight line that:

- passes through the projection on the centering plane of an optical center 203 or of a geometrical center (such as the boxing center) of the desired final outline after shaping 221 of the target corrective lens 200; and
- passes through the projection MO2 of the point O2 homologous to the point O1 of the reference lens 100.

Specifically, the point O2 is therefore situated in the front face of the target corrective lens 200 and on its final outline 201.

In a variant shown in FIGS. 6 and 7, and as mentioned above, the reference anchor line is defined as being the line that is parallel to the horizon line 108 or 109 of the reference lens 100 and that passes through the projection MO2 of the point O2 homologous to the point O1 of the reference lens 100. In this variant, the processor system 54 defines a target anchor line D6, in projection on the centering plane, which target anchor line D6 is homologous to the line D4 associated with the reference lens 100. In the example shown in FIGS. 6 and 7, this target anchor line D6 is defined as being the straight line that:

- is parallel to the horizon line 202, 203 of the target corrective lens 200 and
- passes through the projection MO2 of the point O2 homologous to the point O1 of the reference lens 100.

The position of the target anchor point O2 of the target corrective lens 200 is thus known.

Since the curvatures of the reference and corrective lenses 100 and 200 are not identical, the point C10 is not homologous to the point C1 in the sense defined above.

In a first method, in order to calculate the position of the target drilling point C10, a characteristic of the overall curvature of the target corrective lens 200 is determined.

The characteristics of the curvature of the target corrective lens 200 can be determined in a number of different ways.

The angle ALPHA200 of the axis A210 along which the target corrective lens 200 should be drilled (which angle is characteristic of the curvature of the target corrective lens 200 at the drilling point C10) can typically be defined relative to the lighting direction D51. The angle thus constitutes said looked-for characteristic of the curvature.

To this end, knowing that the curvature of the target corrective lens 200 is continuous and approximately constant in a local zone of the front face 198 of the lens, a first method of determining the angle ALPHA200 consists in feeling the front face 198 of the target corrective lens 200 in a local zone considered to be close to the position that will be presented by the drilling point C10 to be positioned. More precisely, this method consists firstly in defining an approximate point C11 a priori situated in the proximity of the drilling point C10. Here, the approximate point C11 is selected as being the point homologous to the point C1 of the reference lens 100. Then, the front face of the corrective lens 200 is sensed by feeling at three distinct points situated within 10 millimeters from the approximate point C11. The processor system 54 can thus determine the orientation of the plane tangential to the front face of the corrective lens 200 at the approximate point C11. The orientation of this plane relative to the acquisition plane P1 is substantially identical to the orientation relative to the same acquisition plane P1 presented by the plane that is tangential to the front face of the corrective lens 200 at the drilling point C10. The angle of inclination of this tangential plane relative to the acquisition plane P1 corresponds to the angle ALPHA200, which can thus be calculated with precision.

In a second method of calculating the angle of inclination ALPHA200 of the optical face 198 or 199 of the target corrective lens 200 at an approximate point C11 and relative to the centering plane analogous to the acquisition plane P1, the overall curvature is acquired of one of the optical faces 198, 199 of the target corrective lens 200, specifically of the front face 198, an approximate point C11 is identified on the optical face 198, which approximate point C11 is close to the target drilling point C10 for the target drill hole 210 and the angle of inclination ALPHA200 is calculated as a function of said overall curvature and of the position of the approximate point C11. By way of example, the processor system 54 identifies the approximate point C11 as the point whose projection MC11 on the centering plane presents a position that is homologous to the position of the projection MC1 of the reference drilling point C1 of the reference drill hole 110 in the acquisition plane P1.

In a variant, the angle ALPHA200 may be determined otherwise. By way of example, the optician may measure the angle manually on the lens and then enter the information by means of an on-screen data entry interface 50 provided for this purpose.

In a further variant, the angle ALPHA200 may also be calculated by the processor system 54 from the calculated position of the approximate point C11 and from the base of the lens that is generally provided to the optician by the manufacturer of the lens and that the optician will have input by means of the on-screen data input interface. In this event, the angle ALPHA200 is calculated by means of the following relationship:

$$\mathrm{ALPHA200}=(R\cdot B/(n-1))$$

R being the distance, projected onto the acquisition plane P1, from the center C10 to the geometrical center of the outline of the corrective lens (obtained by image processing), B being the base of the lens, and n being the index number of the lens. The base of the lens may be input manually by the operator by means of an on-screen data input interface, or obtained, for example, by a spherometer.

In any event, the processor system 54 can then calculate, by trigonometry, the target distance in projection R3 that ought to exist in the centering plane analogous to the acquisition plane P1 between the projection MC10 of the drilling point C10 and the projection MO2 of the target anchor point O2, to ensure that the three-dimensional target distance R2 between the target anchor point O2 and the target drilling point C10 is equal to the distance R2. The calculation is as follows:

$$R3=R2\cdot\cos(\text{ALPHA200}).$$

Knowing the position of the target anchor point O2 and the target distance in projection R3 between the target anchor point O2 and the drilling point C10, the projection thereof on the centering plane is fully determined.

In a variant, the processor system may calculate the three-dimensional position of the target drilling point C10 by transferring the three-dimensional reference distance R2 onto the target corrective lens 200 using a target anchor point O2. This transfer is made substantially along the local inclination of the face concerned of the target corrective lens 200 (here, the front face), i.e. substantially along a transfer direction connecting the target anchor point O2 to the target drilling point C10, as shown in FIG. 3.

Since the orientation of the axis A210 of the target drill hole 210 is also known, a grinder or conventional drill provided with a drill bit can proceed to drill the target drill hole 210 in the corrective lens so that the lens is completely mountable on the rimless frame selected by the future wearer.

If it is desirable to drill the target corrective lens 200 from its rear face 199, the method is identical to the method described above, with the exception being that is necessary to define the anchor points O1 and O2 and the reference C1 and drilling C10 points as belonging to the rear face 199 of the corrective lens 200.

Determining the Position of a Second Drill Hole Associated to the Above-described First Hole.

Figure 8:
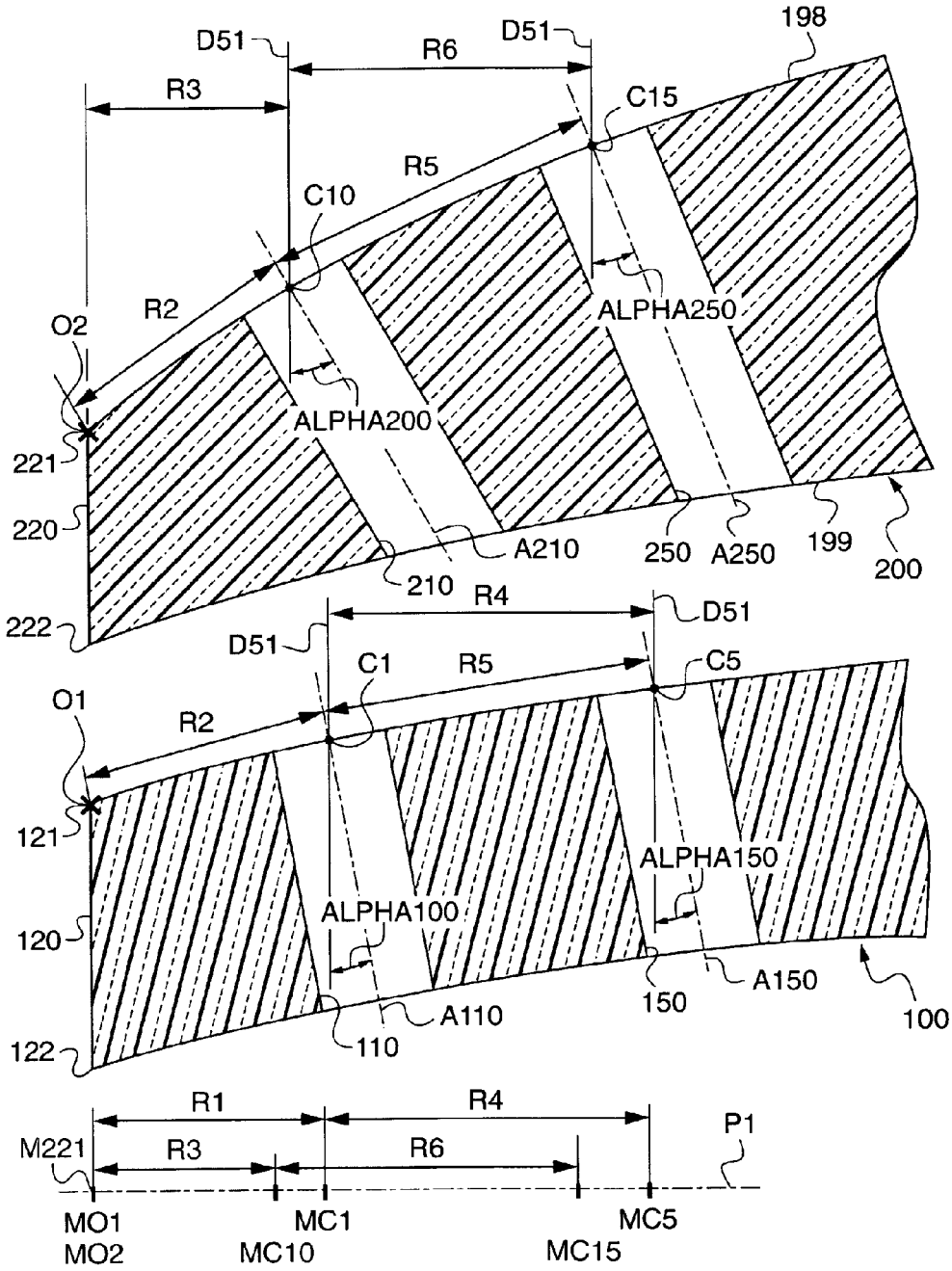
FIG. 8 is a combined view, with a bottom portion in section showing a portion of another reference lens provided with two adjacent drill holes, and a top portion in section showing a portion of another drilled target corrective lens using the method in accordance with the invention.

Certain eyeglass frames differ from those previously studied in the sense that they require two drill holes for fastening a temple or a bridge onto the lens. Under such circumstances, as shown in the bottom portion of FIG. 8, the reference lens 100 includes four reference drill holes 110, 150 situated on the temporal zone and two other drill holes (not shown) situated on the nasal zone. In an analogous manner, the corrective lens shown in the top portion of FIG. 8 is intended to be drilled with two target drill holes 210, 250 on the temporal zone and with two other drill holes (not shown) on the nasal zone.

The method of determining the position of the two target drill holes 210, 250 of the corrective lens 200 is similar to the method described above for a lens presenting two drill holes.

The processor system 54 firstly determines, on the reference lens 100, the distance R1 in the acquisition plane P1, between the projection MO1 of the reference anchor point O1 and the projection MC1 of the center C1 in the front face of the orifice of the first reference drill hole 110, and, secondly, the distance R4 in the acquisition plane P1, between the projection MC1 of the center in the front face in the orifice of the first reference drill hole 110 and the projection MC5 of the center in the front face of the orifice of the second reference drill hole 150.

The method of determining the distance R1 is entirely identical to the method as described above, with the same references, for a lens with two drill holes that are isolated from each other. The method of determining the distance R4 differs from the method for determining the distance R1 in that the reference anchor point from which the distance R4 is measured corresponds to the projection MC1 of the center C1 of the first reference drill hole 110. The technique is otherwise identical and will not be described in further detail. In addition the method enables the angle ALPHA150 between the lighting direction D51 and the axis A150 of the second reference drill hole 150 to be acquired. In a variant, calculating this angle can be avoided by making the approximation that the angles ALPHA100 and ALPHA150 are equal.

The processor system 54 then proceeds to calculate, firstly, the distance R2 between the reference anchor point O1 of the reference lens 100 and the center C1 of the orifice in the front face of the first reference drill hole 110, and, secondly, the distance R5 between the centers C1 and C5 of the orifices in the front faces of the first and second reference drill holes 110, 150.

The method of determining the distance R1 is entirely identical to the method as described above with the same references. Since the axis A150 of the reference drill hole 150 is orthogonal to the plane tangential to the front face of the reference lens at the point C5, the angle ALPHA150 as determined above enables the distance R5 to be estimated by means of the following calculation:

$$R5=R4/\cos(\text{ALPHA150}).$$

As shown in the top portion of FIG. 8, the processor system 54 proceeds to identify, in the front face 198 of the target corrective lens 200, target drilling points C10, C15 at which it is appropriate to drill the corrective lens 200.

The drilling point C10 is likewise identified here by using a method that is identical to that described above for a lens with two drill holes.

The drilling point C15 is itself identified by taking the drilling point C10 as the target anchor point of the target corrective lens 200. The purpose of this identification is to determine the position of the projection MC15 of the drilling point C15 in the acquisition plane P1

The angular position of the drilling point C15 and of its projection MC15 about the axis A52 of the corrective lens 200 is known since they both belong to the radial plane P4 under consideration. The distance R6 in the acquisition plane P1 between the projection MC10 of the drilling point C10 and the projection MC15 of the drilling point C15 remains to be determined.

For this it is necessary to define, relative to the lighting direction D51, the angle ALPHA250 of the axis A250 along which the lens should be drilled for the second target drill hole 250. The angle may be determined in a manner analogous to one of the manners presented for determining the angle ALPHA200. In a variant, it is also possible to make the approximation that the angles ALPHA200 and ALPHA250 are equal, since the two target drilling points 210, 250 are adjacent.

The processor system 54 thus calculates, by trigonometry, the distance R6 that ought to exist in the acquisition plane P1 between the projection MC15 of the drilling point C15 and the projection MC10 of the drilling point C10 to ensure that the distance in three dimensions between the drilling point C10 and the drilling point C15 is equal to the distance R5. The calculation is as follows:

$$R6=R5/\cos(\text{ALPHA250}).$$

Knowing the angular positions of the drilling points C10, and C15 about the axis A52 of the corrective lens 200, and knowing the distances R3 and R6, the drilling points C10 and C15 are fully determined in the acquisition plane P1. Since the orientations of the axes A210 and A250 of the target drill holes 210 and 250 are also known, a grinder or conventional drill provided with a drill bit can proceed to drill the target drill holes 210 and 250 in the corrective lens 200 so that the lens is completely mountable on the rimless frame selected by the future wearer.

Variant Embodiment of the Image Acquisition Device

Figure 9:
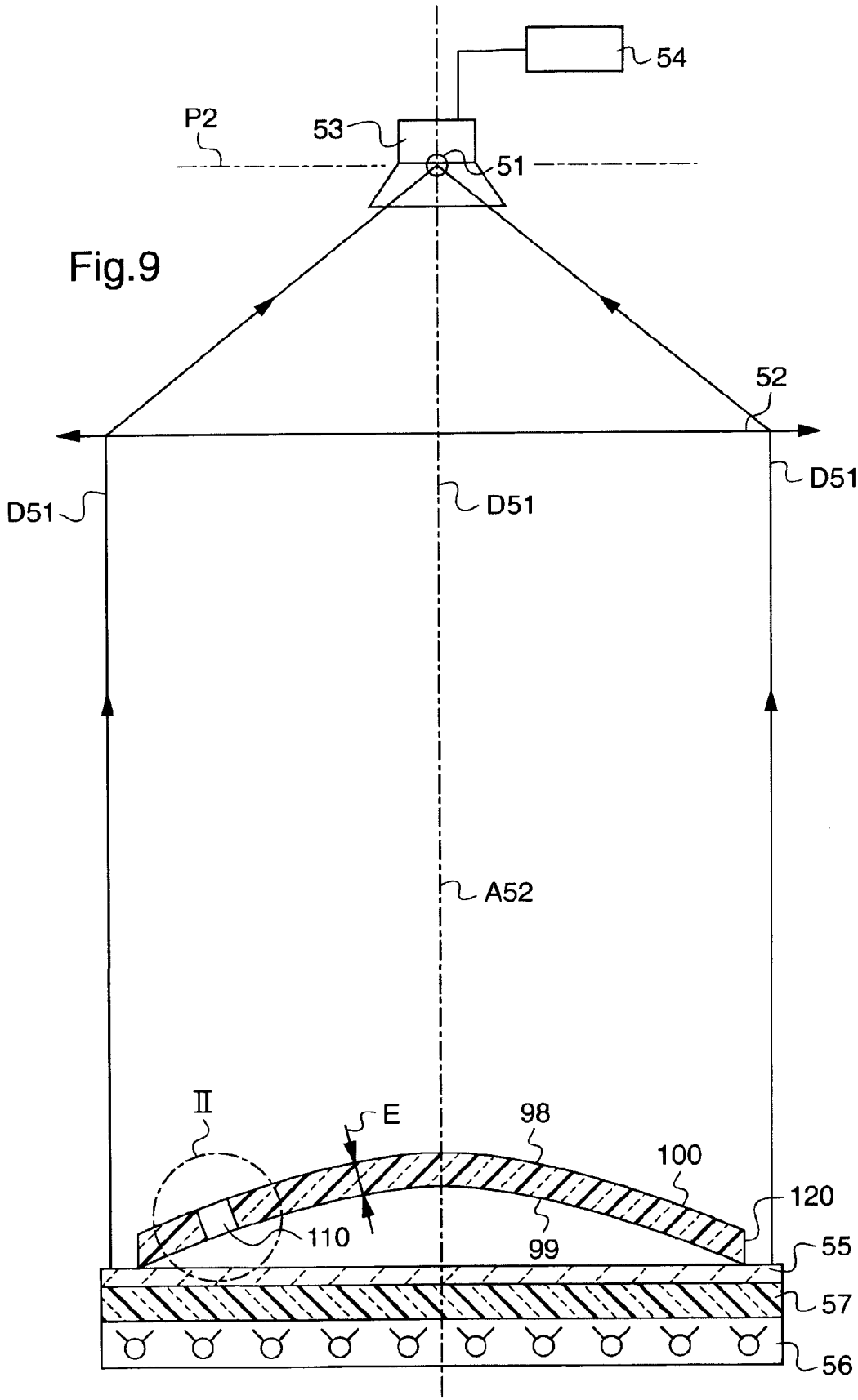
FIG. 9 is a diagrammatic view in axial section of a variant embodiment of the acquisition device of FIG. 1.

In another embodiment shown in FIG. 9, the reference lens 100 is directly viewed by the camera 53. The camera 53 is arranged in such a manner that the optical axis of its lens is parallel with the lighting direction and that the optical center of its lens is situated at the focal point 51 of the collimator lens 52. A back-lighting assembly, made up of a matrix of light sources such as LEDs 56 and a diffusion plate 57, is positioned on the side of the support plate 55 opposite from the lens 100.

The camera 53 thus sees the front face of the reference lens 100 directly, i.e. without an intermediate projection screen.

As above, the camera lens acquires the image of the eyeglass lens in an acquisition plane orthogonal to the image capture direction A52. The acquisition plane is not identifiable on the structure of the device in this embodiment. Here, it corresponds to the image plane P2 of the collimator lens 52. It is in the image plane P2 that a sharp image is formed of the reference lens 100 seen by the collimator lens 52.

The various implementations described above using a projected view to calculate the position of the orifice in the front or rear face of the drilling hole can be implemented using a direct view.

More generally, the exact position XMC1 of the center of the orifice of the front face is easily obtained since there is no deflection of the light rays by the lens.

The base of the lens may be input manually by the operator by means of an on-screen data input interface, or it may be obtained, for example, by a spherometer.

The present invention is not limited in any way to the embodiments described and shown, but the person skilled in the art will be able to apply any variant in the spirit of the invention.

The invention claimed is:

1. A method of determining the position of a target drill hole (210; 250) to be drilled in a target corrective lens (200) having an expected target outline (220) after shaping, the position being determined from a reference lens (100) that presents a reference outline (120) and at least one reference drill hole (110; 150), the method comprising the following steps:

acquiring an image of the reference lens (100) in an acquisition plane (P1; P2), in particular including an image of its reference outline (120) and an image of its reference drill hole (110; 150);

deducing therefrom the position relative to the target outline (220) of the target drilling point (C10; C15) for a target drill hole (210; 250) of the target corrective lens (200);

the method being characterized in that it further comprises the following steps:

acquiring at least one characteristic (ALPHA100; ALPHA150) of the curvature of the reference lens (100);

determining, in the acquisition plane (P1; P2), the reference distance in projection (R1; R4) between the projection (MO1; MC1) of a reference anchor point (O1; C1) of the reference lens (100), this reference anchor point being associated with the reference outline (120), and the projection (MC1; MC5) of a reference drilling point (C1; C5) of the reference drill hole (110; 150);

calculating the three-dimensional reference distance (R2; R5) between the reference anchor point (O1; C1) of the reference lens (100) and the reference drilling point (C1; C5) of the reference drill hole (110; 150) as a function of said characteristic (ALPHA100; ALPHA150) of the curvature of the reference lens (100) and of the determined reference distance (R1; R4) in projection; and determining the position of the target drilling point (C10; C15) for the target drill hole (210; 250) of the target corrective lens (200) as a function of the calculated three-dimensional reference distance (R2; R5).

2. A method according to claim 1, wherein, in order to determine the position of the target drilling point (C10; C15) for the target drill hole (210; 250), a target anchor point (O2; C10) of the target corrective lens (200) homologous to the reference anchor point (O1; C1) of the reference lens (100) is identified, and the position of the target drilling point (C10 C15) is calculated as a function of the target anchor point (O2; C10) and of the three-dimensional reference distance (R2; R5).

3. A method according to claim 2, wherein the reference anchor point (O1; C1) and the reference drilling point (C1; C5) belong to a single reference face of the reference lens (100), and the target anchor point (O2; C10) and the target drilling point (C10; C15) belong to a single target face of the target corrective lens (200), said reference face and said target face corresponding to each other.

4. A method according to claim 2, wherein, in order to calculate the position of the target drilling point (C10; C15), the three-dimensional reference distance (R2; R5) is transferred onto the target corrective lens (200), starting from said target anchor point (O2; C10), substantially along a transfer direction linking the target anchor point (O2; C10) to the target drilling point (C10; C15).

5. A method according to claim 2, wherein, in order to calculate the position of the target drilling point (C10; C15), at least one characteristic (ALPHA200; ALPHA250) of the curvature of the target corrective lens (200) is determined and the target distance (R3; R6) in projection is calculated, in a centering plane that is analogous with the acquisition plane (P1; P2), between the projection (MC10; MC15) of the target drilling point (C10; C15) for the target drill hole (210; 250) of the target corrective lens (200) and the projection (MO2; MC10) of the target anchor point (O2; C10) of the target corrective lens (200), as a function of the three-dimensional reference distance (R2; R5) and of the characteristics (ALPHA200; ALPHA250) of the curvature of the target corrective lens (200).

6. A method according to claim 5, wherein, in order to determine said characteristic (ALPHA200; ALPHA250) of the curvature of the target corrective lens (200), an approximate point (C11) near to the target drilling point (C10; C15) of the target drill hole (210; 250) is identified on one of the optical faces (198, 199) of the target corrective lens (200), said optical face (198, 199) of the target corrective lens (200) is sensed by feeling at least three points situated in the neighborhood of the approximate point (C11), and therefrom there is deduced an angle of inclination (ALPHA200; ALPHA250), relative to the centering plane (P1), of said optical face (198, 199) of the corrective lens (200) at said approximate point (C11), said angle thus constituting said looked-for characteristic of the curvature.

7. A method according to claim 5, wherein, in order to determine said characteristic (ALPHA200; ALPHA250) of the curvature of the target corrective lens (200), the overall curvature of one of the optical faces (198, 199) of the target corrective lens (200) is acquired, an approximate point (C11)

near to the target drilling point (C10; C15) of the target drill hole (210; 250) is identified on one of the optical faces (198, 199) of the target corrective lens (200), and an angle of inclination (ALPHA200; ALPHA250) relative to the centering plane (P1) is calculated for said optical face (198, 199) of the target corrective lens (200) at the approximate point (C11) as a function of said overall curvature and of the position of the approximate point (C11), said angle thus constituting said looked-for characteristic of the curvature.

8. A method according to claim 7, wherein, for the image of the target corrective lens (200) being acquired in the centering plane (P1), the approximate point (C11) is identified as the point having its projection (MC11) in the centering plane (P1) presenting a position that is homologous to the position of the projection (MC1; MC5) of the reference drilling point (C1; C5) of the reference drill hole (110; 150) in the acquisition plane (P1).

9. A method according to claim 8, wherein the reference anchor point (O1) of the reference lens (100) is identified as the point having its projection (MO1) in the acquisition plane situated at the intersection between, firstly, a projected outline (M121) resulting from the projection of one of the front and rear edges (121, 122) of the edge face (120) of the reference lens (100) or of an average of these edges, and, secondly, a reference anchor line (D3, D4) passing through the projection (MC1) of the reference drilling point (C1) of the reference drill hole (110).

10. A method according to claim 9, wherein said reference anchor line (D3) passes through the projection (CB) of a geometrical center (CB) of the reference lens (100) or is parallel to the horizon lines (108, 109) of the reference lens (100).

11. A method according to claim 9, wherein the target anchor point (O2) of the target corrective lens (200) is identified as the point, that has its projection (MO2) in a centering plane analogous to the acquisition plane (P1; P2), that presents a position homologous to the position of the projection (MO1) of the reference anchor point (O1) of the reference lens (100) in the acquisition plane (P1).

12. A method according to claim 9, wherein, in order to determine the position of the target drilling point (C10; C15), it is considered that the projection (MC10; MC15) of said point in a centering plane that is analogous to the acquisition plane (P1; P2) belongs to a target anchor line (D5; D6) homologous to the reference anchor line (D3; D4).

13. A method according to claim 2, wherein, for a reference lens (100) including two adjacent reference drill holes (110, 150) designed to hold a single temple or a single nose bridge of a frame, namely a first reference drill hole (110) and a second reference drill hole (150), and for a target corrective lens (200) presenting two target holes (210, 250) to be drilled, namely a first target drill hole (210) corresponding to the first reference drill hole (110) of the reference lens (100) and of position that is already identified, and a second target drill hole (250), the reference anchor point of the reference lens (100) for determining the second target drill hole (250) is constituted by the reference drilling point (C1) of the first reference drill hole (110).

14. A method according to claim 13, wherein the target anchor point of the target corrective lens (200) is constituted by the target drilling point (C10) of the first target drill hole (210).

15. A method according to claim 1, wherein, for a reference lens (100) including two adjacent reference drill holes (110, 150) designed to hold a single temple or a single nose bridge of a frame, namely a first reference drill hole (110) and a second reference drill hole (150), and for a target corrective lens (200) presenting two target holes (210, 250) to be drilled, namely a first target drill hole (210) corresponding to the first reference drill hole (110) of the reference lens (100) and of position that is already identified, and a second target drill hole (250), the reference anchor point of the reference lens (100) for determining the second target drill hole (250) is constituted by the reference drilling point (C1) of the first reference drill hole (110).

16. A method according to claim 3, wherein, in order to calculate the position of the target drilling point (C10; C15), the three-dimensional reference distance (R2; R5) is transferred onto the target corrective lens (200), starting from said target anchor point (O2; C10), substantially along a transfer direction linking the target anchor point (O2; C10) to the target drilling point (C10; C15).

17. A method according to claim 3, wherein, in order to calculate the position of the target drilling point (C10; C15), at least one characteristic (ALPHA200; ALPHA250) of the curvature of the target corrective lens (200) is determined and the target distance (R3; R6) in projection is calculated, in a centering plane that is analogous with the acquisition plane (P1; P2), between the projection (MC10; MC15) of the target drilling point (C10; C15) for the target drill hole (210; 250) of the target corrective lens (200) and the projection (MO2; MC10) of the target anchor point (O2; C10) of the target corrective lens (200), as a function of the three-dimensional reference distance (R2; R5) and of the characteristics (ALPHA200; ALPHA250) of the curvature of the target corrective lens (200).

18. A method according to claim 10, wherein the target anchor point (O2) of the target corrective lens (200) is identified as the point, that has its projection (MO2) in a centering plane analogous to the acquisition plane (P1; P2), that presents a position homologous to the position of the projection (MO1) of the reference anchor point (O1) of the reference lens (100) in the acquisition plane (P1).

19. A method according to claim 10, wherein, in order to determine the position of the target drilling point (C10; C15), it is considered that the projection (MC10; MC15) of said point in a centering plane that is analogous to the acquisition plane (P1; P2) belongs to a target anchor line (D5; D6) homologous to the reference anchor line (D3; D4).

20. A method according to claim 11, wherein, in order to determine the position of the target drilling point (C10; C15), it is considered that the projection (MC10; MC15) of said point in a centering plane that is analogous to the acquisition plane (P1; P2) belongs to a target anchor line (D5; D6) homologous to the reference anchor line (D3; D4).

* * * * *